US007815465B2

(12) United States Patent
Wang et al.

(10) Patent No.: US 7,815,465 B2
(45) Date of Patent: Oct. 19, 2010

(54) ELECTRIC CONNECTOR ASSEMBLY

(75) Inventors: Chien Chun Wang, Taoyuan (TW); Wen Lun Wang, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 12/420,211

(22) Filed: Apr. 8, 2009

(65) Prior Publication Data

US 2009/0264009 A1 Oct. 22, 2009

(30) Foreign Application Priority Data

Apr. 18, 2008 (TW) ..... 97114562 A

(51) Int. Cl.
*H01R 12/24* (2006.01)

(52) U.S. Cl. ..... 439/496

(58) Field of Classification Search ..... 439/496, 439/495

See application file for complete search history.

(56) References Cited

U.S. PATENT DOCUMENTS 3,084,302 A * 4/1963 Braeutigam ..... 439/327
3,144,288 A * 8/1964 Grant ..... 439/496
3,482,201 A * 12/1969 Schneck ..... 439/497
3,696,319 A * 10/1972 Olsson ..... 439/496
5,030,144 A * 7/1991 Seidler ..... 439/876
5,344,343 A * 9/1994 Seidler ..... 439/876
5,904,589 A * 5/1999 Asakawa ..... 439/495
6,394,833 B1 * 5/2002 Bulmer et al. ..... 439/393
6,641,431 B2 * 11/2003 Saitoh ..... 439/495
6,790,102 B2 * 9/2004 Stillabower et al. ..... 439/856
7,467,970 B2 * 12/2008 Ikuta et al. ..... 439/496
7,530,839 B1 * 5/2009 Lee ..... 439/496

* cited by examiner

*Primary Examiner*—Gary F. Paumen
(74) *Attorney, Agent, or Firm*—Egbert Law Office PLLC

(57) ABSTRACT

The present invention discloses an electric connector assembly including an insulator body, a fixed part, multiple terminals, a flexible flat cable (FFC) and a metal case. The insulator body has a rectangular base, multiple accommodating tanks are located one side of the base, and an inserting part passing through the inner place of the base is located at the edge of the other side of the base. The fixed part is assembled at the inserting part of the insulating body and can accommodating multiple terminals. Each terminal has an upper contact arm and a lower contact arm, which can simultaneously contact with the FFC and maintain the steadiness of the FFC. At least one side surface of the FFC has multiple contact points, which are clipped between the terminals for electrically connection. The metal case covering one side of the insulator body seizes the FFC to achieve the grounding function.

8 Claims, 6 Drawing Sheets

ELECTRIC CONNECTOR ASSEMBLY

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention is related to an electric connector assembly, particularly to an electric connector assembly comprising multiple terminals with upper and lower contact arms, which can contact the contact points of flexible flat cable (FFC) in two directions, and the inserting angles for FFC can be changed depending on demand. The steadiness of FCC also can be maintained while the electric connector assembly contacts the FFC. Besides, the electric connector assembly comprises a two-piece-type of plastic core for saving the materials of multiple terminals, and a metal case for joining the FFC.

2. Description of Related Art Including Information Disclosed Under 37 CFR 1.97 and 37 CFR 1.98

Currently, a flexible printed circuit (FPC) is usually used in dynamic circuit connecting parts, or assembling parts disposed on different planes in current electronic products. FPC has many advantages, such as high density of wiring, light weight, thin thickness and less limitation for wiring space, high flexibility, so FPC is widely applied to many fields, such as PC and peripheral products, communication products, monitor, and consuming electronic products. FPC is generally provided with an electric connector connected at the edge, so as to electrically transmit the electric signals easily.

A conventional electric connector applied in this field has a rectangular insulator body with a slot, and therein is disposed with multiple conductive terminals. The contact part of conductive terminal is protruded out of the slot, so that FFC can be inserted into the slot, and the contact points of FFC can be joined on the contact part. The butt joint of terminal is exposed on the insulator body for inserting into the butt joint connector for electric connection. A metal case is covered on the insulator body, for touching the surface of FFC to prevent FFC from shedding off, and thereby every contact of FFC and every conductive terminal can contact each other steadily.

However, in the procedure of manufacturing the aforesaid connector, multiple terminals only touch the contact points of one side of FFC, and it causes much restriction while FFC is designed or assembled. Furthermore, when being contacted with multiple terminals, FFC tends to be affected by the stress and moment and thereby resulting in deformation. Besides, because the insulator body is thick, many materials will be wasted in a mold punching process. Though the metal case can be joined to FFC and prevent electromagnetic wave interfering, the designs of the iron case are usually so sophisticated that make manufacturing procedure complicated.

BRIEF SUMMARY OF THE INVENTION

Therefore, one of objectives of the present invention is to provide an electric connector assembly which comprises multiple terminals which have an upper contact arm and a lower contact arm each, so that Flexible Flat Cable (FFC) can be normally or reversely inserted in the electric connector assembly depending on demand. When contacting with FFC, the upper contact arm and lower contact arm can maintain the steadiness of FFC under external force.

Another objective of the present invention is to provide an electric connector assembly which has significant design of the inserting part of insulator body and fixed part, so the insulator body can be effectively connected with multiple terminals, and the waste of materials during mold punching process can be reduced, and the resource can be used efficiently and the cost can be saved.

Another objective of the present invention is to provide an electric connector assembly which has a special punched shape of the metal case, so the iron case and plastic core can seize FFC to achieve the grounding function.

To achieve the above-mentioned objectives, the present invention discloses an electric connector assembly comprising an insulator body, a fixed part, multiple terminals, a FFC and a metal case. The insulator body has a rectangular base, and multiple accommodating tanks are disposed in one side of the base, and an inserting part passing through the inner place of the base is disposed at the edge of the other side of the base. Locking mechanisms are disposed at the opposite sides of the base, and each locking mechanism is provided with an accommodating tank for accommodating a metal dome. The fixed part with a plurality of slots is assembled in the inserting part of the insulator body and capable of accommodating multiple terminals which have an upper contact arm and a lower contact arm each for electrically contacting with FFC and maintaining the steadiness of the FFC under external force. Multiple contact points are disposed on at least one side of the FFC, and clipped between the terminals for electrically connection. The metal case is use to cover on the insulator body and join FFC for forming the grounding function.

BRIEF DESCRIPTION OF THE SEVERAL VIEWS OF THE DRAWINGS

The subject matter regarded as the invention is particularly pointed out and distinctly claimed in the concluding portion of the specification. The invention together with features and advantages thereof may best be understood by reference to the following detailed description with the accompanying drawings.

DETAILED DESCRIPTION OF THE INVENTION

Figure 1:
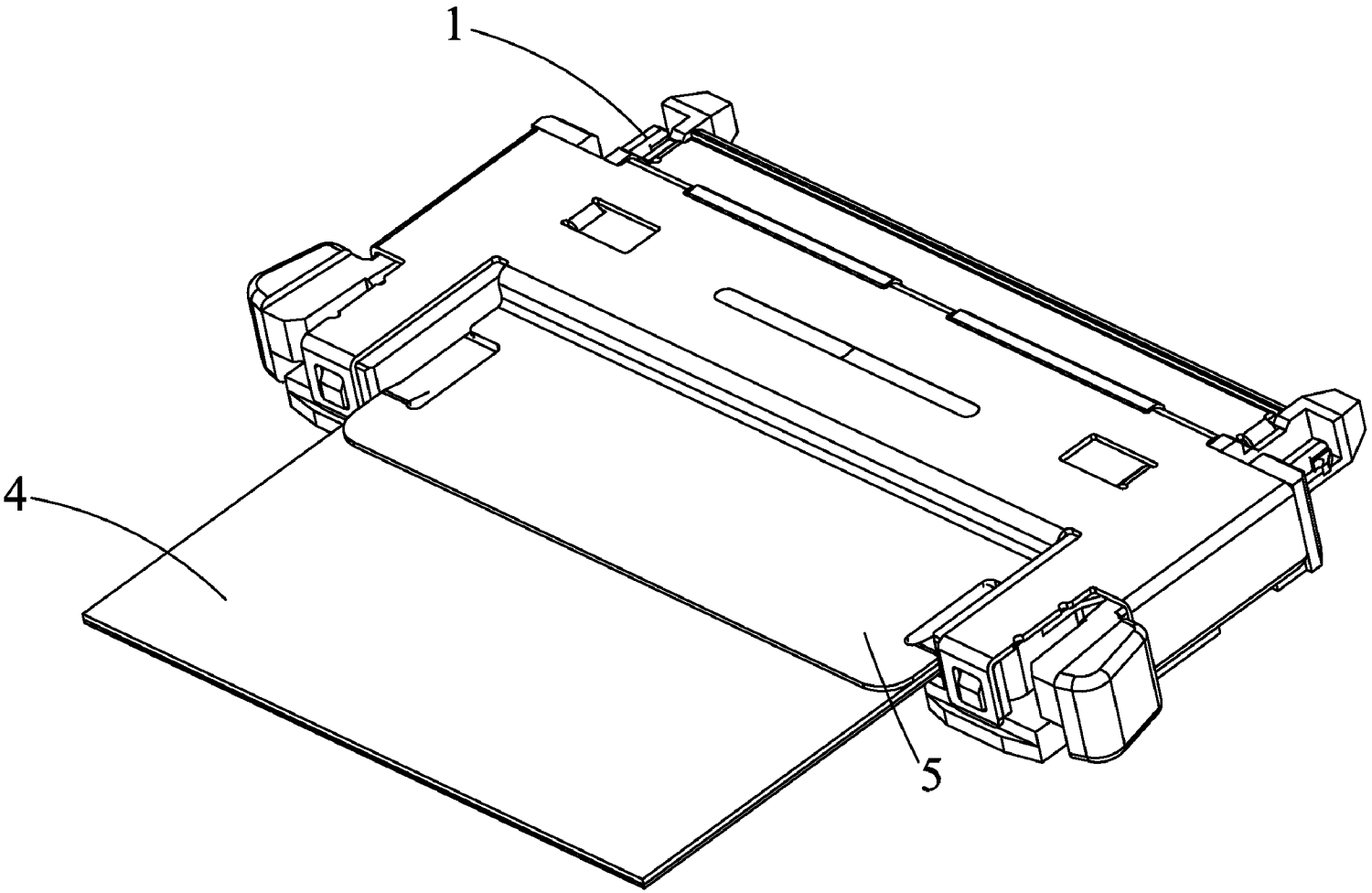
FIG. 1 is a perspective view of an electric connector assembly of the present invention.
Figure 2:
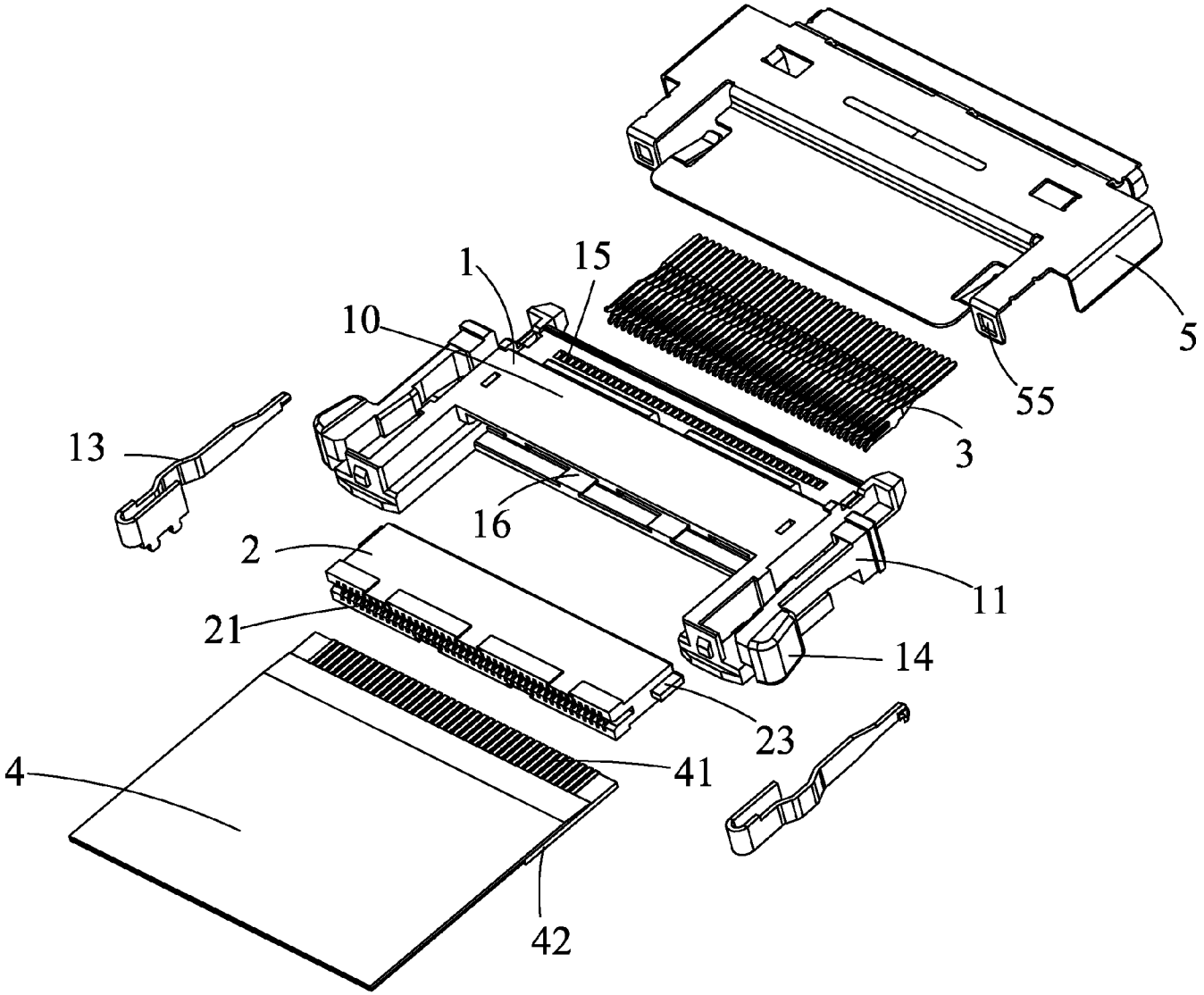
FIG. 2 is an exploded perspective view of the present invention, including the decomposition chart of an electric connector assembly of the present invention.

Referring to FIG. 1 and FIG. 2 for a three dimensional assembly drawing and a three dimensional decomposition chart of the present invention respectively, one of the preferred embodiments of this present invention is introduced. The electric connector assembly comprises an insulator body 1, a fixed part 2, multiple terminals 3, a flexible flat cable (FFC) 4 and a metal case 5.

Figure 3:
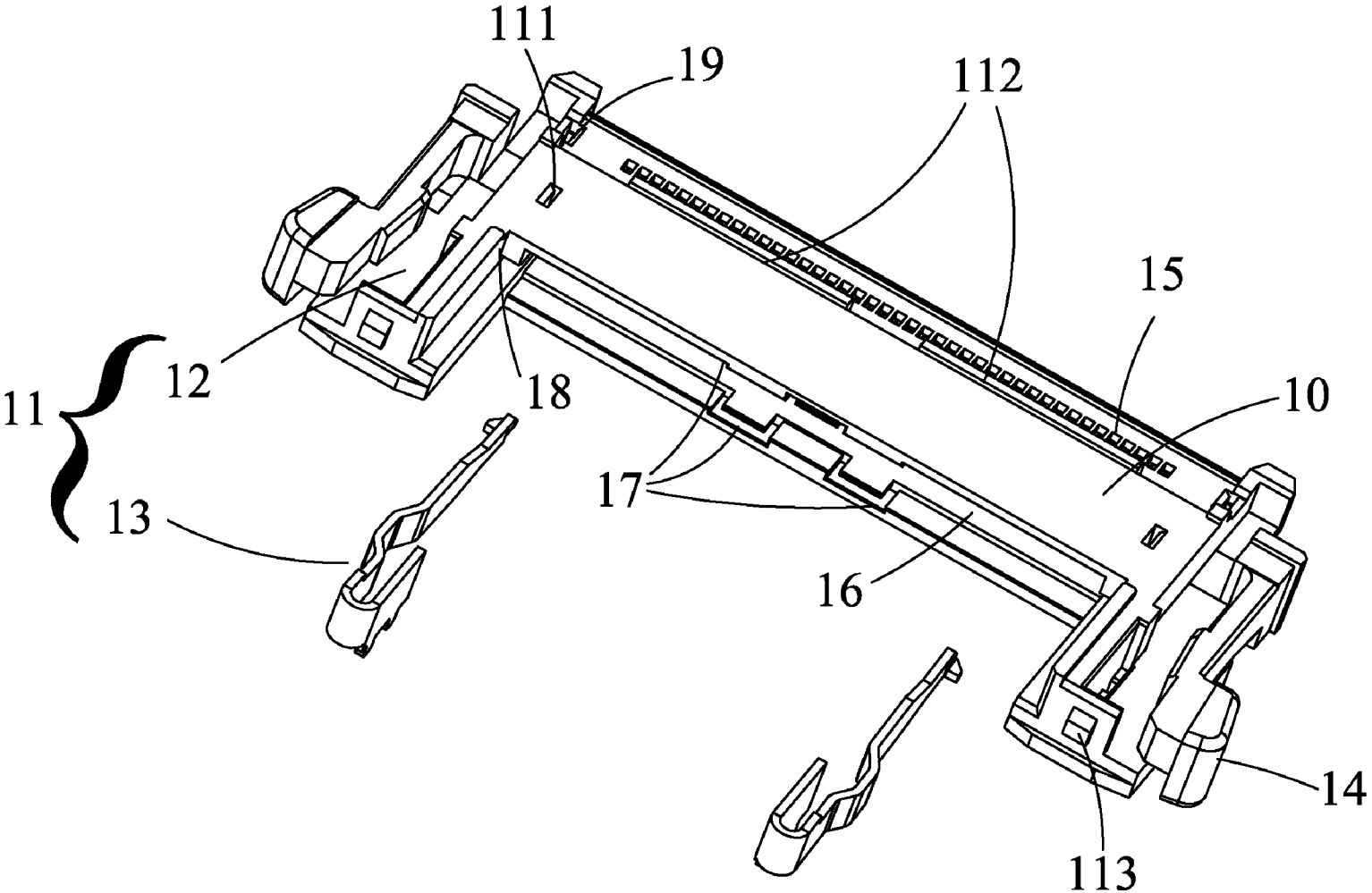
FIG. 3 is a perspective view of the insulator body of the present invention.

FIG. 3 illustrates a three dimensional drawing of an insulator body of the present invention. The insulator body 1 has a rectangular base 10, and locking mechanisms 11 are disposed at the opposite two sides. The locking mechanism 11 has accommodating tank 12 for disposing a metal dome 13. When the pressing part 14 is pressed, metal dome 13 will be affected to move and thereby the locking state of the locking mechanism 11 will be unlocked. The locking mechanism 11 has a protruded point 113 disposed at its end, and the protruded point 113 is used to interfere with buckling holes 55 of metal case 5. Multiple accommodating tanks 15 are disposed on the side edge of base 10 for accommodating butt joints 33 of multiple terminals 3. At the other side edge of base 10 opposite to the side with accommodating tank 15, an inserting part 16 is disposed thereon, and the inserting part 16 passes through the inner place of base 10. The height of the inserting part 16 matches to the entire thickness of the fixed part 2 so that the inserting part 16 can be assembled into the fixed part 2 and form interference with the fixed part 2. The upper side and lower side of the inserting part 16 are provided with multiple grooves 17, which restrain and embed multiple protruded parts 22 of fixed part 2 each other. A resisting tank 18 is disposed in the inserting part 16, for interfering with the resisting part 23 of fixed part 2 to stabilize the assembly structures of fixed part 2 and insulator body 1. A first interference hole 19 and a second interference hole 111 are disposed on the surface of base 10, and a first interference slice 51 and a second interference slice 52 of metal case 5 can be placed into first interference hole 19 and a second interference hole 111 for forming interference. Multiple ribs 112 are disposed on base 10 for coupling with the bare part 54 of metal case 5.

Figure 4:
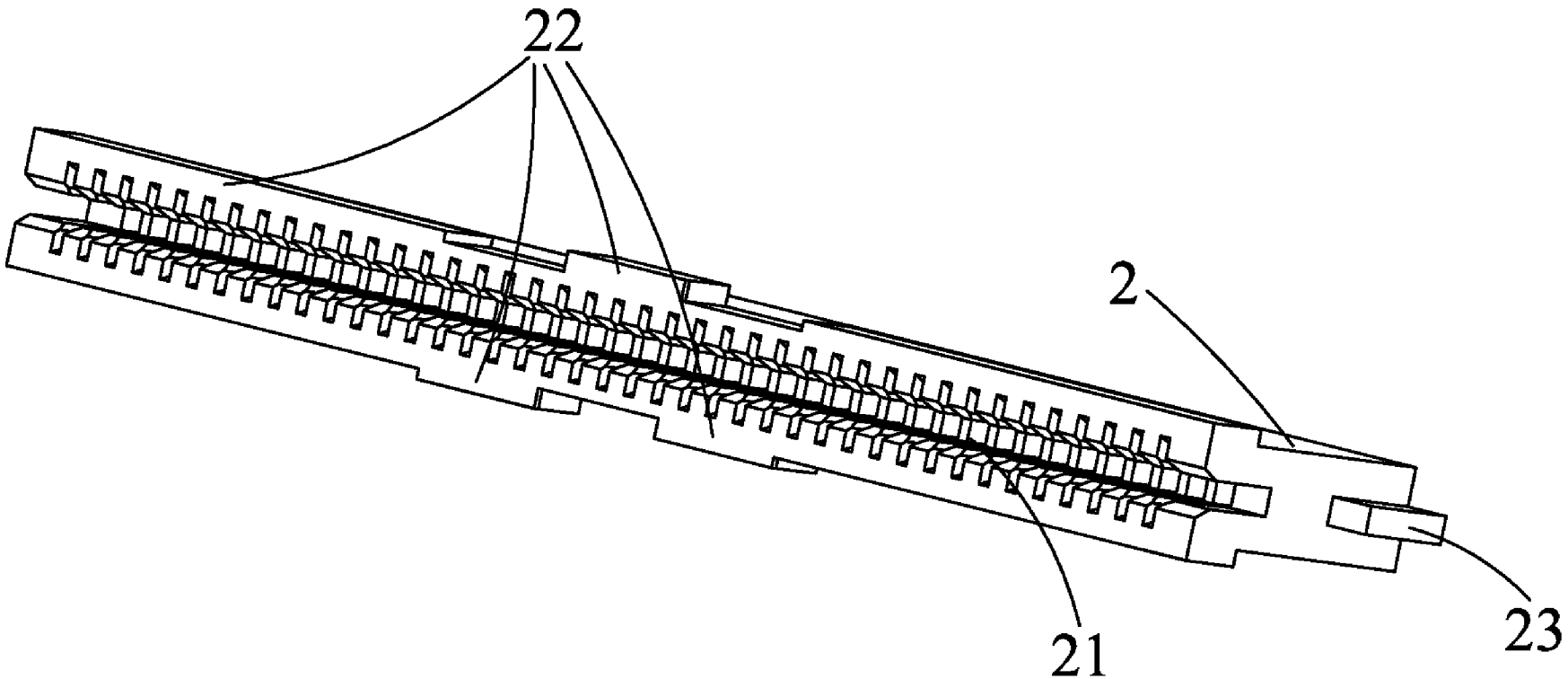
FIG. 4 is a perspective view of a fixed part of the present invention.

Referring to FIG. 4 for a three dimensional drawing of a fixed part of the present invention, the fixed part 2 appears in "⊂" shape in side view, and is made of insulation plastics and has multiple slots 21 for installing multiple terminals 3. The fixed part 2 is pretty thin, so the interval between terminals can be reduced, it causes reduced waste of materials, and manufacturing cost can be further saved when multiple terminals 3 are punched. The fixed part 2 has multiple protruded parts 22 for interfering with multiple grooves 17 of insulator body 1 when the fixed part 2 is assembled into the inserting part 16 of insulator body 1. The fixed part 2 has a resisting part 23 which is assembled into resisting tank 18 of the insulator body 1 for wedging with resisting tank 18.

Figure 5:
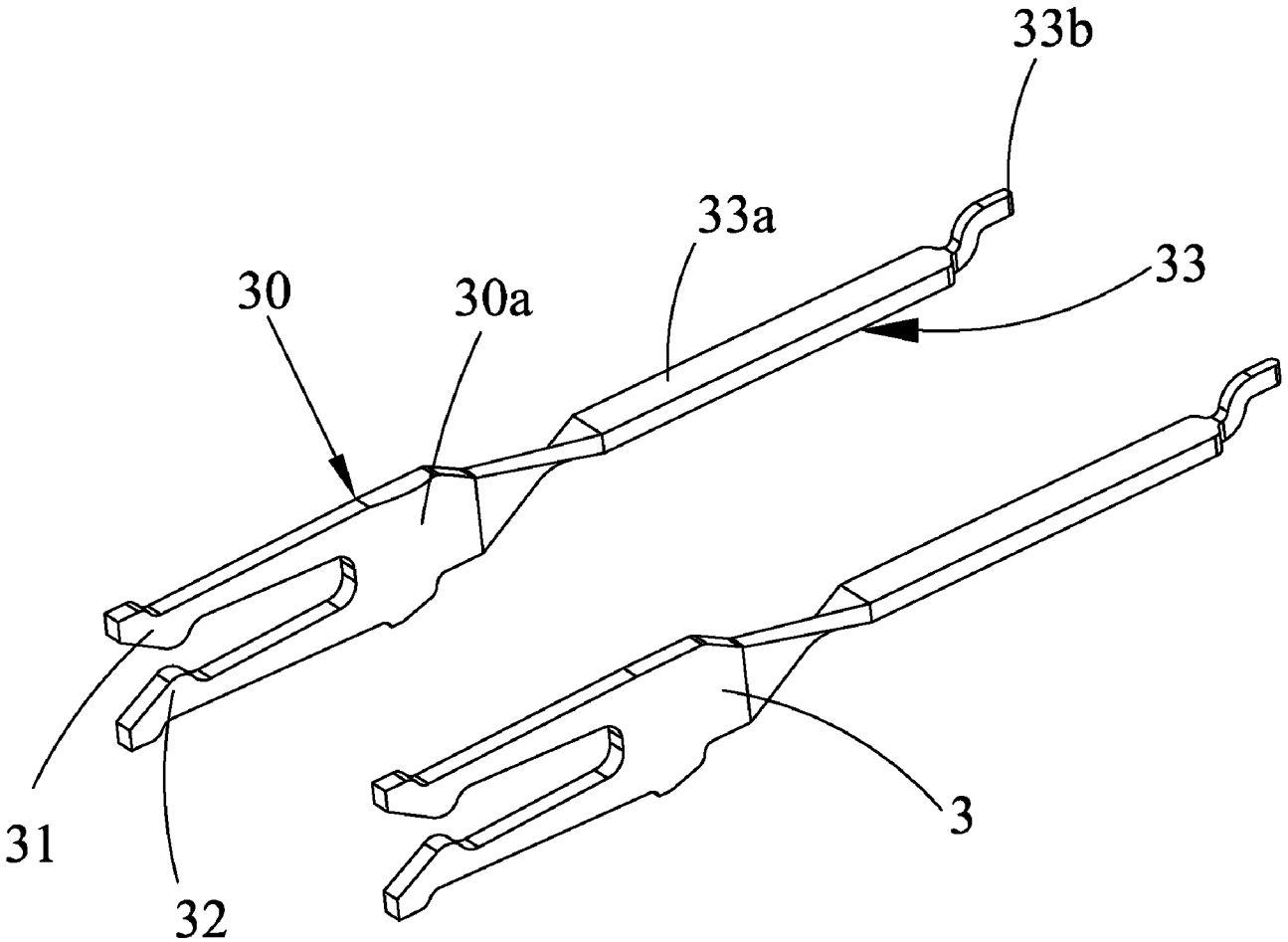
FIG. 5 is a perspective view of terminals of the present invention.

Referring to FIG. 5 for a three dimensional drawing of terminals of the present invention, multiple terminals 3 are separately fixedly installed in multiple slots 21 of fixed part 2. Each terminal 3 has a contact part 30 and a flexibly extended butt joint 33. In the embodiment, the contact part 30 comprises an upper contact arm 31 and a lower contact arm 32 which is disposed corresponding to the upper contact arm 31. The upper contact arms 31 and lower contact arms 32 are assembled into multiple slots 21 to seize and touch FFC 4, and flexibly contact with the multiple contact points 41 of FFC 4 for forming electrically connection. The butt joints 33 are inserted into multiple accommodating tanks 15 of the insulator body 1 to electrically connect with other connector. Besides, at one side of the butt joints 33 has a hook **33*b* disposed thereon, which can steadily position the butt joints 33 in multiple accommodating tanks 15 and avoid warpage. Because the multiple terminals 3 have an upper contact arm 31 and a lower contact arm 32 each for contacting with multiple contact points 41, FFC 4 can be normally or inversely inserted into the terminals depending on demand. Besides, the upper contact arms 31 and lower contact arms 32 of multiple terminals 3 can seize FFC 4, so that FFC 4 is not apt to be bent and deformed under external force, thereby the electrical signal can be maintained stably. In the embodiment, each terminal 3 is integrally formed together as a one-piece by punching a metal slice. The surface of the punched surface 33*a* of the butt joint 33 is flat and has larger area, so it is suitable for electroplating process and to be an electrically connection surface. However, in view of the structures of the upper contact arm 31 and lower contact arm 32 of the contact part 30 are also formed on the identical punched surface 30*a*, in order to make the direction of normal line of the contact surface of the multiple contact point 41 which are clipped by the upper contact arm 31 and lower contact arm 32 is parallel to the direction of normal line of the electrically connection surface of the butt joints 33 of the terminal 3, the punched surface 33*a* of the butt joints 33 corresponding to the punched surface 30*a* of the contact part 30 is bent by 90°, so that the multiple contact points 41 of the FFC 4 and the external connector are respectively electrically connected to the contact part 30 and the butt joints 33** in vertical upper and lower direction.

At least one face of the end of FFC 4 is disposed with multiple contacts 41 for electrically connecting to the upper contact arms 31 and lower contact arms 32 of multiple terminals 3. Besides, a reinforced slab 42 is disposed on one side of FFC 4.

Figure 6:
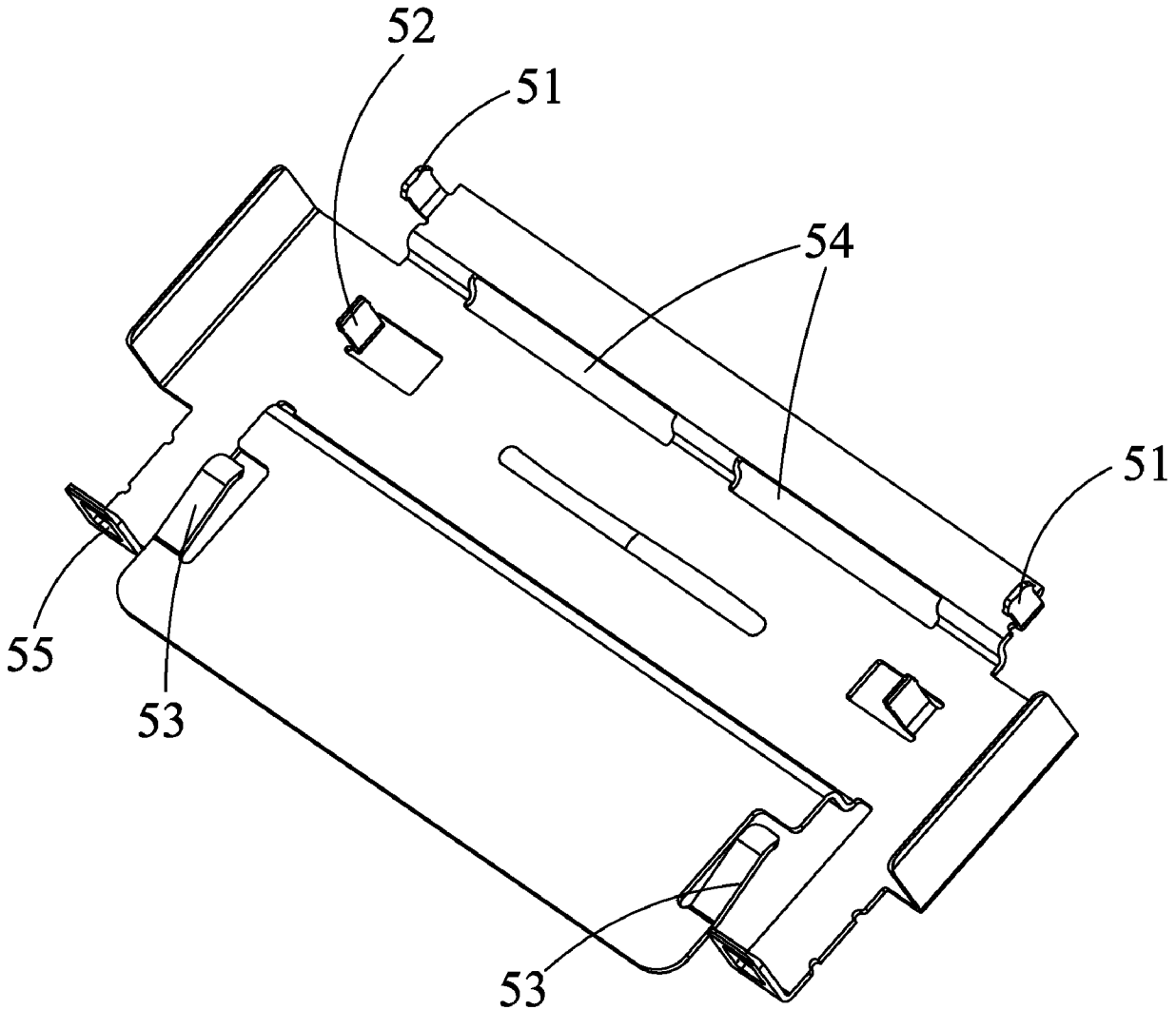
FIG. 6 is a perspective view of a metal case of the present invention.

FIG. 6 illustrates a three dimensional drawing of a metal case of the present invention. The metal case 5 is a structure of plate form and used to cover on the insulator body 1, and shaped in one piece. Two sides of metal case 5 are disposed with a first interference slice 51 and second interference slice 52 corresponding to the first interference hole 19 and the second interference hole 111 respectively, for stabilizing the contact between metal case 5 and insulator body 1. The metal case 5 is not only applied to reinforce the structure of insulator body 1, but also applied to fix metal dome 13 disposed in accommodating tanks 12 of locking mechanism 11. The metal case 5 has a bent joint slice 53 for joining to FFC 4 to prevent electromagnetic wave interfering when being assembled with insulator body 1. Further, the metal case 5 has a bare part 54 capable of interfering with multiple ribs 112 of insulator body 1. The metal case has buckling holes 55 at two ends at its front side respectively, for buckling the protruded point 113 of locking mechanism 11.

During the assembly of the aforesaid structure, the fixed part 2 is assembled into the inserting part 16 of insulator body 1 first, and the resisting part 23 of fixed part 2 is embedded into resisting tank 18 along insulator body 1 for forming an interference restriction. Meanwhile, multiple protruded parts 22 of fixed part 2 interfere with multiple grooves 17 of insulator body 1 to maintain the steadiness of insulator body 1 and fixed part 2. And then, multiple terminals 3 are inserted and positioned into multiple slots 21 of fixed part 2. At this time, butt joint 33 of multiple terminals 3 is inserted into multiple accommodating tanks 15 of insulator body 1. Next, the FFC 4 is assembled. FFC 4 is horizontally inserted into fixed part 2 and seized between upper contact arms 31 and lower contact arms 32 of multiple terminals 3, so that upper contact arms 31 and lower contact arms 32 can steadily contact the contact points 41 of FFC 4, and seize and fix FFC 4 to prevent from bending and deforming under external force, and signals can be maintained stable. Then the metal dome 13 is assembled into accommodating tank 12 of locking mechanism 11. Finally, the metal case 5 is assembled downward onto insulator body 1, and the first interference slice 51 and the second interference slice 52 of metal case 5 penetrate the first interference hole 19 and the second interference hole 111 of insulator body 1, and the bare part 54 of metal case 5 can interfere with multiple ribs 112 of insulator body 1. The buckling holes 55 disposed at two ends of the front side of metal case 5 buckle the protruded points 113, and joint slice 53 disposed on the metal case 5 is joined to FFC 4, thereby an effective grounding result is achieved.

The aforesaid assembly procedure is easy to be performed. Besides, this electric connector assembly has fixed part 2 which is thinner than the insulator body 1. The multiple terminals 3 are manufactured by mold punching a piece of metal plank with an arrangement interval which is the same as the thickness of the insulator body 1. The transverse arrangement interval can be reduced when the fixed part 2 is thinner than the insulator body 1, and it results in reduced waste of materials in a mold punching process, and more manufactured terminals 3 in one mold punching process. Moreover, multiple terminals 3 have upper contact arms 31 and lower contact arms 32, so the FFC 4 can be normally or inversely inserted to electric connect to multiple terminals 3. The inserting angle of FFC 4 can be adjusted depending on the demand. The upper contact arms 31 and lower contact arms 32 can stabilize the structure of FFC 4. The structure of metal case 5 is shaped in one piece and bent, and the metal case 5 has a joint slice 53 for forming grounding with FFC 4 to prevent electromagnetic wave interfering and enhance the steadiness of signal transmission.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

We claim:

1. An electric connector assembly comprising:

an insulator body having a rectangular base, wherein one side of the base is disposed with an inserting part passing through an inner place of said rectangular base, and another side of said rectangular base opposite to said inserting part is disposed with multiple accommodating holes;

a fixed part assembled into said inserting part of said insulator body, said fixed part having multiple slots;

a flexible flat cable having a end placed into said inserting part, and at least one side of said rectangular end of said flexible flat cable having multiple contact points;

multiple terminals inserted respectively in said accommodating holes and said slots, wherein each of said multiple terminals has a butt joint and a contact part, said contact part being accommodated in the slot, said butt joint being accommodated in the accommodating hole; and a metal case covering on the insulator body, wherein each of said multiple terminals are integrally formed by punching, at least one portion of said butt joint being offset by 90° from said contact part.

2. The electric connector assembly of claim 1, wherein said contact part has an upper contact arm and a lower contact arm, said upper contact arm and said lower contact arm are used to seize and electrically connect to the contact points of said flexible flat cable.

3. The electric connector assembly of claim 1, wherein said fixed part has multiple protruded parts, said insulator body has multiple grooves, said multiple protruded parts interfere respectively with said multiple grooves to dispose said fixed part on said insulator body.

4. The electric connector assembly of claim 1, wherein said fixed part has a resisting part, said insulator body has a resisting hole, said resisting hole interferes with said resisting part so as to dispose said fixed part on said insulator body.

5. The electric connector assembly of claim 1, wherein the metal case has at least a bent joint slice which is formed integrally by bending the metal case and presses against said flexible flat cable.

6. The electric connector assembly of claim 1, further comprising:

a locking mechanism located at a pair of sides of said rectangular base, said locking mechanism having a metal dome and an accommodating region, wherein the metal dome is a bent metal slice and integrally formed together and accommodated in the accommodating region.

7. The electric connector assembly of claim 1, wherein said insulator body has an integrally-formed first interference hole and a second interference hole, and said metal case has a first interference slice, said first interference slice and said second interference slice are respectively inserted in said first interference hole and said second interference hole.

8. An electric connector assembly comprising:

an insulator body having a rectangular base, wherein one side of said rectangular base is disposed with an inserting part passing through an inner place of said rectangular base, and another side of said rectangular base opposite to said inserting part is disposed with multiple accommodating holes;

a flexible flat cable having a end placed into said inserting part, at least one face of said end disposed with multiple contact points;

multiple terminals respectively inserted in said multiple accommodating holes, wherein each terminal has a butt joint and a contact part, and said contact part is accommodated in said inserting part, and said butt joint is accommodated in the accommodating hole, said contact part has an upper contact arm and a lower contact arm, the upper contact arm and the lower contact arm are used to seize and electrically connect to the contact points of said flexible flat cable so as to maintain a steadiness of the structure of said flexible flat cable; and a metal case covering on said insulator body, wherein the terminals are integrally formed by punching, and at least one portion of said butt joint off set by 90° from said contact part.

* * * * *